US005740704A

United States Patent [19]

Payne

[11] Patent Number: 5,740,704

[45] Date of Patent: Apr. 21, 1998

[54] SOCKET WRENCH

[76] Inventor: Jerry A. Payne, Rte. 1, Box 42AA, Ravenswood, W. Va. 26164

[21] Appl. No.: 696,889

[22] Filed: Aug. 21, 1996

Related U.S. Application Data

[63] Continuation-in-part of Ser. No. 334,872, Nov. 4, 1994, abandoned, which is a continuation-in-part of Ser. No. 225,691, Apr. 11, 1994, abandoned, which is a continuation-in-part of Ser. No. 199,110, Feb. 22, 1994, abandoned.

[51] Int. Cl.[6] ..... B25B 13/46; B25B 13/28; B25B 7/14

[52] U.S. Cl. ..... 81/60; 81/54; 81/57.39; 81/338; 81/112; 81/90.2; 279/50

[58] Field of Search ..... 81/52, 54, 57, 81/57.11–57.14, 57.28–57.31, 57.39, 57.44, 318–325, 328, 336–338, 361, 392, 112–114, 116, 60–63.2, 90.2, 90.3, 90.9, 91.3; 279/50–51, 57–58, 74, 43, 43.1, 43.2, 43.4, 37, 107, 906

[56] References Cited

U.S. PATENT DOCUMENTS 1,429,861 9/1922 Flodin .

2,592,978 4/1952 Trimboli .

*Primary Examiner*—D. S. Meislin

*Attorney, Agent, or Firm*—Trexler, Bushnell, Giangiorgi & Blackstone, Ltd.

[57] ABSTRACT

A ratchet wrench (10) includes a unitary socket assembly (20) having a collet (26) and an adjustable fastener engaging socket (24) which may be positioned over a conventional fastener and which may then be decreased in diameter to effect a gripping attachment of a fastener. The socket assembly (20) includes a stud (28) that is releasably engageable with the ratchet wrench (10). A locking lever (80, 80A) is attached to the ratchet wrench (10) and is usable both to decrease the diameter of the socket (24) and to releasably lock the socket in attachment with the fastener. The locking lever (80, 80A) may employ ratchet and pawl members (400, 402). If desired, the ratchet wrench (10) may instead be pneumatically activatable. Further, the wrench (10) also includes a camming means for reducing the diameter of the adjustable fastener engaging socket (24) formed on the inside of the leading edge of the collet (26), and on the outside edge of the socket. The socket (24) comprises a plurality of longitudinally-extending, parallel fingers (36). A plurality of longitudinally extending, parallel slots (200) may be formed inside the collet (26) to receive the fingers (36).

55 Claims, 9 Drawing Sheets

2/9

120
113
114
122
124
130
116
118
110
112
78
83
73
81
80
84
98
100
96
102
104
86
79
19
18
15
85
73
78
12
14
92
88
90
68
57
56
26
61
57
25
24
34
36
33
32
42
28
70
72
40
76
74
20

SOCKET WRENCH

This is a continuation-in-part of application Ser. No. 08/334,872, filed Nov. 4, 1994, which is a continuation-in-part of application Ser. No. 08/225,691, filed Apr. 11, 1994, which is a continuation-in-part of application Ser. No. 08/199,110, filed Feb. 22, 1994, all now abandoned.

TECHNICAL FIELD

The present invention relates to wrenches, and more particularly pertains to a wrench which utilizes an adjustable size socket.

BACKGROUND ART

U.S. Pat. No. 5,207,130, which issued to Jerry A. Payne on May 4, 1993, discloses a socket wrench which utilizes an adjustable size socket and locking mechanism. In broadest terms, this invention comprises a ratchet wrench which includes an adjustable fastener-engaging socket which may be positioned over a fastener and which may then be decreased in diameter to effect a gripping attachment. A locking lever is attached to the ratchet wrench and is usable both to decrease the diameter of the socket and to lock the socket in engagement with the fastener. The lever operates in the manner of a conventional locking plier so as to provide the ratchet socket wrench with a plier-like function.

The socket is generally cylindrical and includes a plurality of longitudinal slots which define a plurality of flexible, longitudinally-extending, parallel fingers. The base of the socket is adapted to be positioned over a conventional fastener such as a six-sided nut, bolthead, or the like. The socket is disposed within a generally cylindrical collet having a lip formed near its base. The socket head is positioned over a fastener, and the lever is squeezed towards the wrench causing it to pivot and causing the socket control collet to move relative to the adjustable socket. The lip formed inside the collet engages the flared end of the socket and forces all of the fingers toward one another. This results in all of the fingers coming into gripping engagement with the fastener. Once a tight engagement has been achieved, the lever is locked in place by a locking mechanism.

It is an object of the present invention to provide a wrench having a socket assembly that can be interconnected as one piece, and novel means for releasably locking the assembly to the wrench.

It is a further object of the present invention to provide such a wrench having novel means for releasably locking the lever to the wrench.

It is a still further object of the present invention to provide such a wrench having an improved camming means for adjusting the size of the socket.

It is a still further object of the present invention to provide a socket for the wrench having an improved design for preventing rotation of the socket relative to the collet.

DISCLOSURE OF INVENTION

In accordance with these and other objects, an improved wrench is provided which includes a socket assembly having an adjustable fastener-engaging socket for positioning over a fastener. In accordance with one embodiment, a locking lever is attached to the wrench and is usable to decrease the diameter of the socket and to effect a gripping attachment with the fastener. In accordance with an alternative embodiment, the wrench may be pneumatically activatable to effect the gripping attachment and, if desired, to apply a torque to the fastener.

The socket assembly in accordance with a preferred embodiment of the present invention comprises a generally cylindrical adjustable socket, a generally cylindrical collet, and a wrench-engaging stud interconnecting the socket and collet. An end of the stud extends from the assembly for releasable engagement with the wrench.

The adjustable socket includes a plurality of parallel fingers and an outwardly extending flare formed on the leading edge of each of the fingers. If desired, additional surface areas may be formed on the outside of the leading edges of the fingers adjacent the flares to provide additional gripping support for the socket and to withstand the torque that is applied to the fastener during use. In one embodiment, the leading edges extend outward from the body of the socket and terminate outside the socket. In another embodiment, the leading edges extend outward from the body of the socket and then laterally inward and backward into the socket to provide additional gripping support for the socket to withstand the torque that is applied to the fastener during use. The other end of the socket is closed except for an aperture defined therein.

The adjustable socket is disposed substantially within a socket-control collet. In one embodiment, the inside of the leading edge of the collet has an outwardly extending flare to cooperate with the flare formed in the adjustable socket, thereby defining a camming means for reducing the radius of the socket. In another embodiment, a plurality of slots or grooves are defined inside the collet to engage the fingers of the socket and counter the torque applied to the fingers when rotating a fastener. The leading edge of each of the grooves preferably includes an outwardly flared portion to cooperate with the flares formed on the fingers of the socket, thereby defining the camming means.

The locking lever, in accordance with one embodiment of the invention, comprises a bent bar that terminates on one end in a bifurcated construction in operable contact with the collet. The bent bar may have a U-shaped cross section along its entire length or a substantial portion of its length to better resist the stress resulting from the operation of the tool. The U-shaped configuration also provides a recess for receiving the handle of the tool to provide a guard between the handle and lever.

An improved locking mechanism is adapted to releasably lock the bar to the wrench at alternative positions to enable the desired socket diameter to be achieved. The locking mechanism may, for example, comprise ratchet and pawl members. After the desired fastening has been achieved, the user can press a release button or cantilever to unlock the lever and expand the socket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the terminology employed herein is for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The present invention and the advantages thereof will become more apparent upon consideration of the following detailed description when taken in conjunction with the accompany drawings.

FIG. 22(*b*) is a cross section view taken along lines (*b*)—(*b*) of FIG. 22(*a*).

MODES FOR CARRYING OUT THE INVENTION

Figure 1:
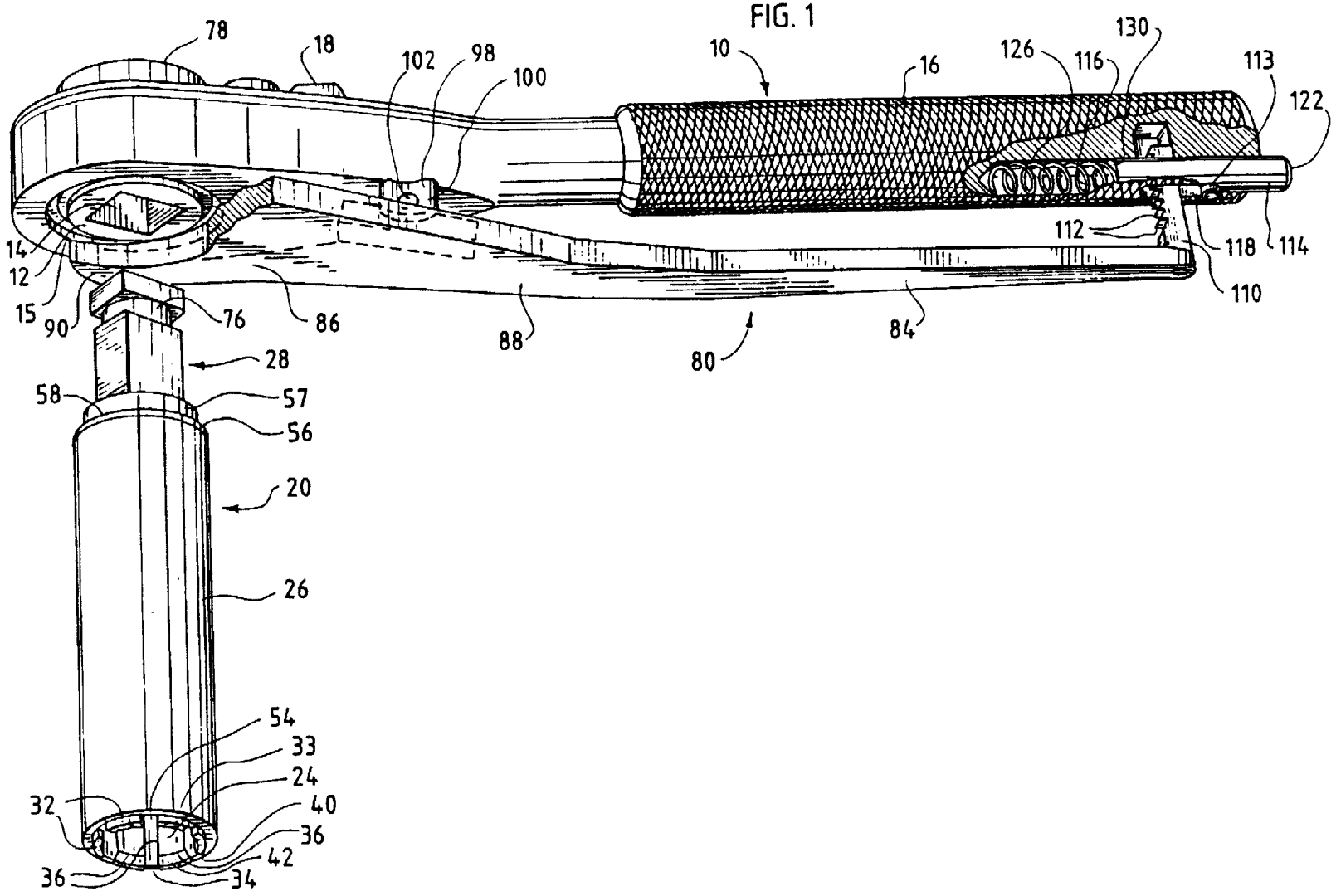
FIG. 1 is a perspective view of a ratchet wrench in accordance with a first embodiment of the invention, illustrating a socket assembly separated from the ratchet wrench and illustrating in broken views the gear or ratchet mechanism and a means for releasably engaging the rear end of a lever.
Figures 2, 3:
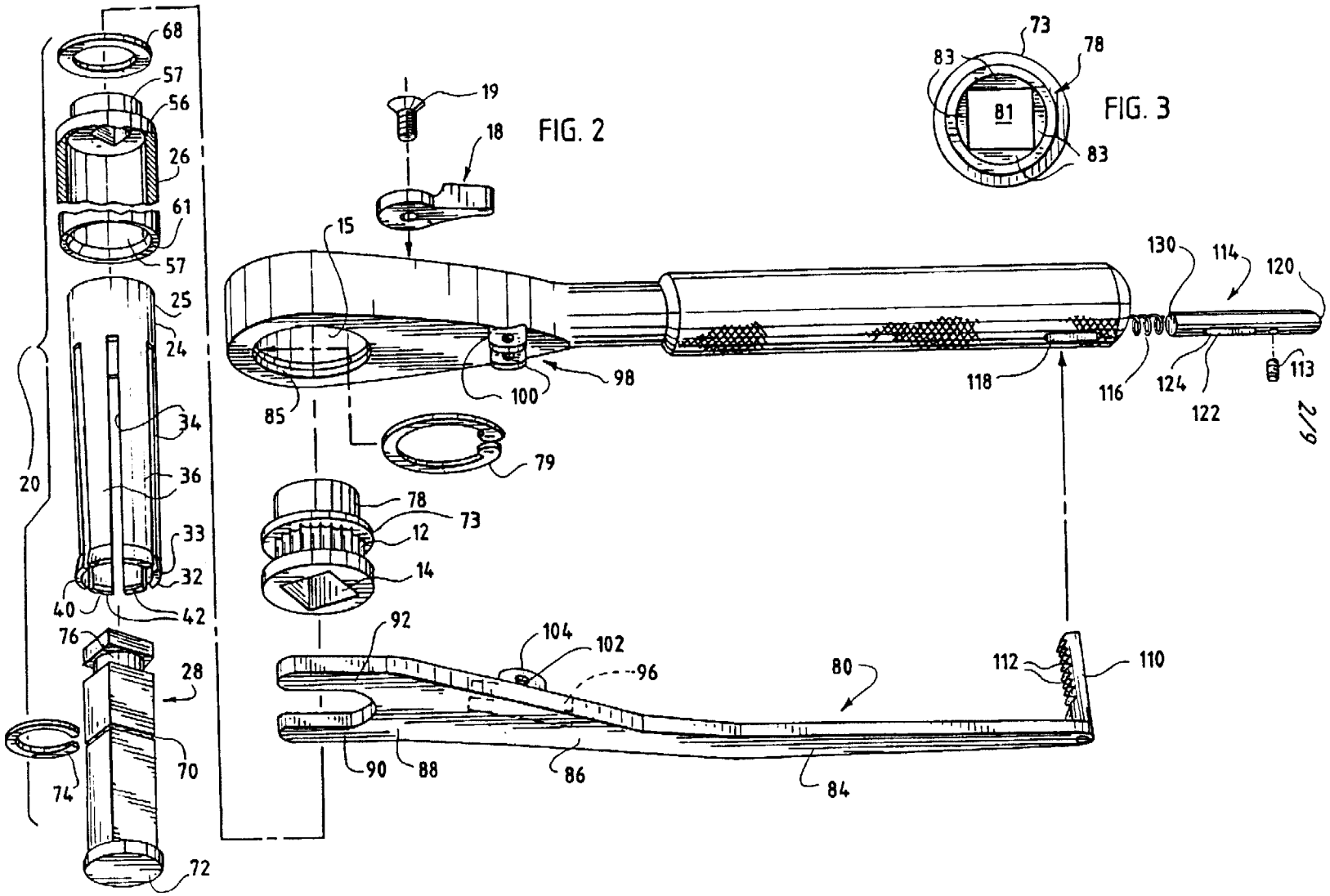
FIG. 2 is an exploded view of the ratchet wrench of FIG. 1.
FIG. 3 is a top view of a knob for releasably engaging the socket assembly of the ratchet wrench of FIGS. 1 and 2.

The first embodiment of the present invention, which is shown in FIGS. 1 and 2, generally comprises a ratchet type socket wrench 10 having a ratchet mechanism or gear 12 of a conventional construction. The ratchet mechanism is secured within a cylindrical bore 15 in the conventional manner, and comprises a square-shaped aperture 14 adapted to receive a fastener-engaging socket. The wrench 10 includes a conventional knurled handle 16 and a conventional selection switch 18, secured by a screw 19, which may be utilized to operate the ratchet mechanism in either a clockwise or counter-clockwise direction.

Figure 4:
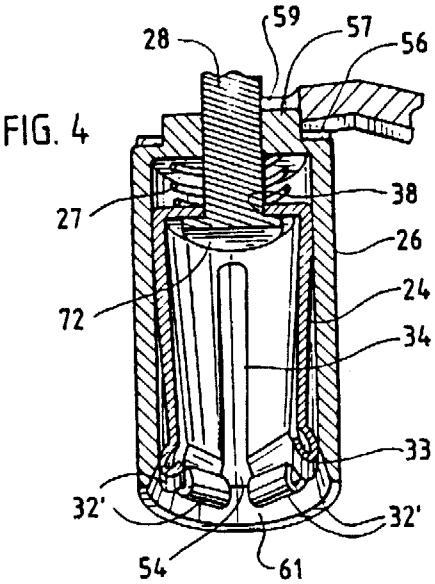
FIG. 4 is a cross section view, taken along its longitudinal axis, of an alternative embodiment of the socket assembly of the ratchet wrench in accordance with the present invention.

In accordance with a preferred embodiment of the invention, wrench 10 is adapted to releasably engage a socket assembly 20. Socket assembly 20 comprises a generally cylindrical adjustable socket 24, a generally cylindrical collet 26 disposed substantially about the socket 24, and a fastener or stud 28 interconnecting the socket and collet. One end of the stud 28 extends from the assembly for releasable engagement with the ratchet wrench 10. If desired, a spring 27 may be disposed between the proximal ends of the socket 24 and collet 26 (see FIG. 4).

The adjustable socket 24 includes a plurality of longitudinally extending slots 34, which define a plurality of flexible, parallel fingers 36 for engaging the fastener. Fingers 36 may extend from a socket base 25 (see FIG. 2) or may extend the entire length of the socket 24 (see FIG. 4). An aperture 38 is defined in the closed end of the socket, which may be square, circular or any other suitable configuration for purposes hereinafter described.

Outwardly extending flares 33 are formed on the leading edges 32 of the fingers 36. Each finger 36 has a curvilinear exterior surface 40, and the leading edge of each finger preferably has a flat planar interior surface 42 for contact with a fastener. (For manufacturing purposes, however, it may be desirable for the interior surface 42 of the socket to be curvilinear along its non-gripping length, as shown, for example, by the transition point 30 appearing in FIG. 16.) Desirably, each surface 42 is substantially parallel to an opposed surface 42 when the fastener is engaged. Preferably there are six fingers 36 so that the socket can be positioned over a conventional fastener such as a six-sided nut, bolthead, or the like.

Figure 12:
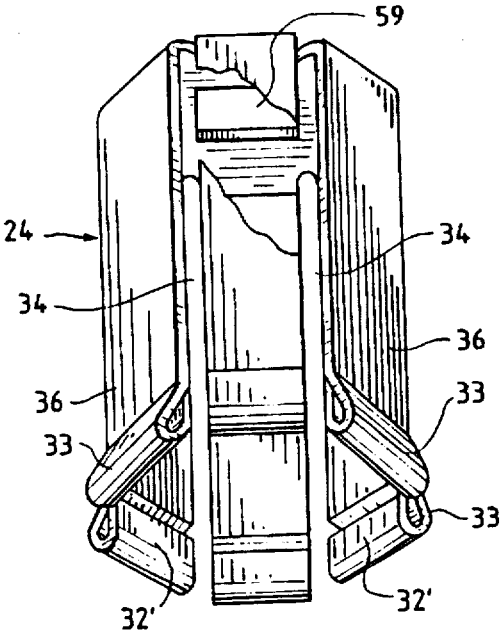
FIG. 12 is a perspective view of one embodiment of the socket of the ratchet wrench in accordance with the present invention.

In one embodiment, the leading edges 32 extend outward from the body of the socket and terminate outside the socket (see FIGS. 1 and 2). In an alternative embodiment, the leading edges 32' extend outward from the body of the socket and then laterally inward and backward into the socket (see FIGS. 4 and 12). The socket may have a one piece metal construction, and the fingers are formed to create the socket. The material may be SAE 1095 cold-rolled annealed spring steel sheet, which is hardened after forming to achieve the desired strength and deflection characteristics.

Figure 16:
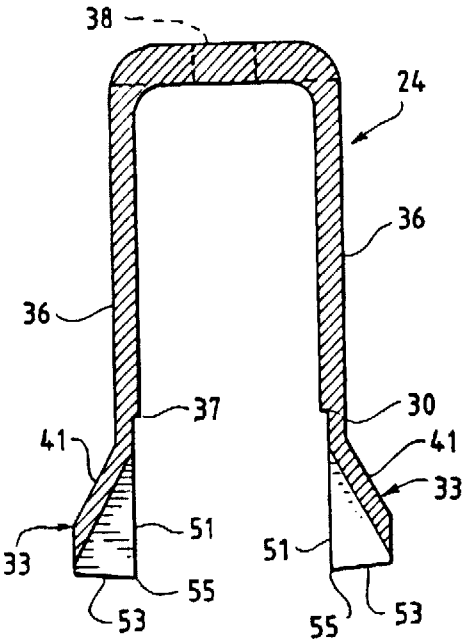
FIG. 16 is a cross section view of the socket of FIG. 15.
Figure 15:
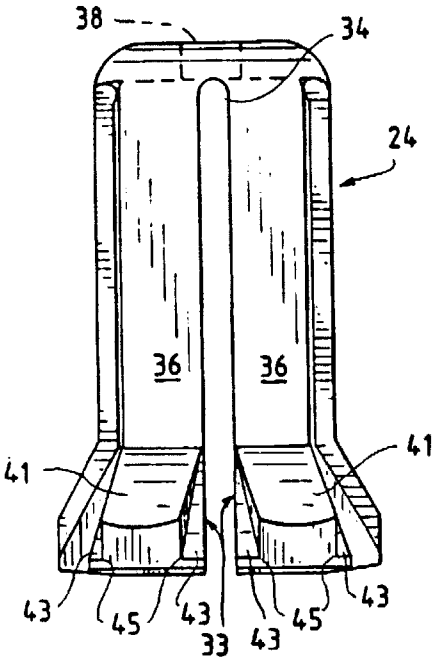
FIG. 15 is a perspective of an alternative embodiment of the socket having reinforcements defined in the back of the leading edges of the socket for increasing the strength of the gripping area of the socket.

A further embodiment of the socket 24, which is shown in FIGS. 15–16, includes reinforcements 41 formed on the outside of each of the flares 33 to reinforce the area for gripping fasteners and further strengthen the fingers 36 and reduce rotation of the socket 24 relative to the collet 26 when securing fasteners. Each reinforcement 41 defines a pair of surfaces areas 43 that preferably are generally triangular surfaces extending outward from the base of the reinforcement. The inside 51 of the leading edge of the open end of the socket is substantially continuous when the socket is fully contracted to provide added gripping strength.

Additionally, preferably, the top 53 and the inside 51 of the leading edges of the socket are flat to define a square corner 55 that extends at an angle of about 85 degrees (see FIG. 16). With this embodiment, when the socket is fully contracted, the top 53 of the leading edge extends substantially parallel to the top surface of the fastener, which is especially desirable in connection with smaller fasteners.

The adjustable socket 24 is disposed substantially within socket-control collet 26. The collet comprises an open end 54 and a closed end 56 having a sleeve 57 with an aperture 59 defined therein. In accordance with one embodiment of the invention, the inside of the leading edge of the collet 26 has an outwardly-extending flare 61 which cooperates with the flares 33 of the socket (FIGS. 1 and 3).

If desired, a plurality of longitudinal grooves 200 may be defined inside the collet 26 to receivingly engage the fingers 36 and prevent or reduce rotation of the fingers relative to the collet. The grooves 200 serve to counter the torque and resist the stress applied to the fingers when rotating the fastener.

Figure 5:
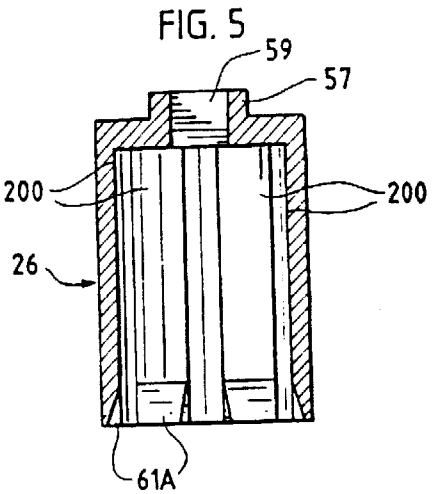
FIG. 5 is a cross section view, taken along its longitudinal axis, of an alternative embodiment of the collet of the ratchet wrench in accordance with the present invention, illustrating a plurality of longitudinal grooves defined inside the collet for receiving the fingers of the socket.
Figure 6:
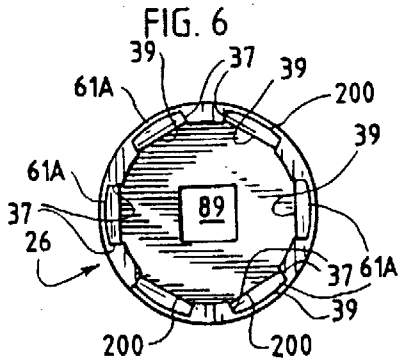
FIG. 6 is a top view of the collet of FIG. 5.
Figures 8, 9:
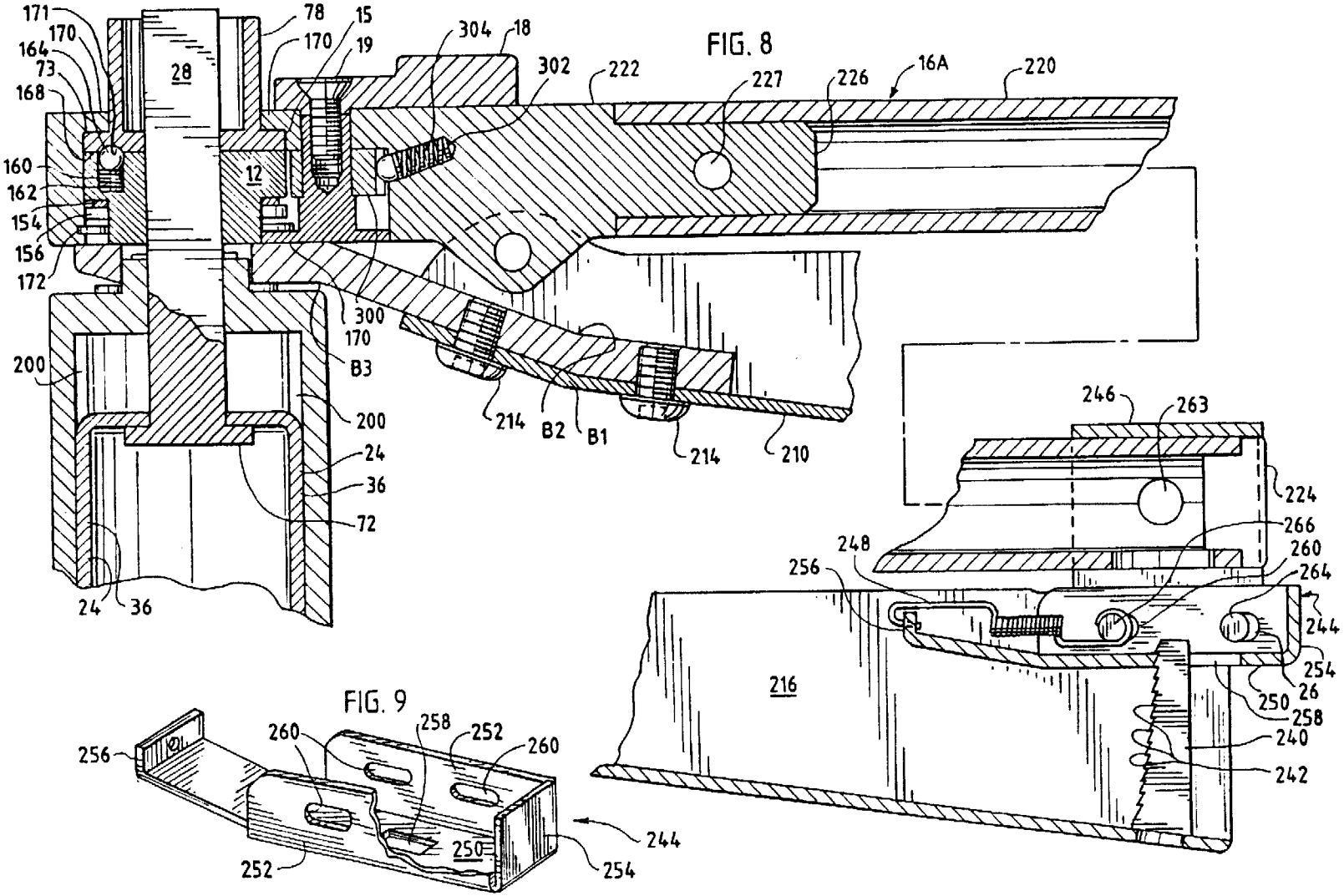
FIG. 8 is a cross section view, taken along its longitudinal axis of the ratchet wrench of FIG. 7, also illustrating the ratchet and ratchet reversing mechanisms.
FIG. 9 is a perspective of a release mechanism that can be used with the ratchet wrench of FIGS. 8 and 9.
Figure 10:
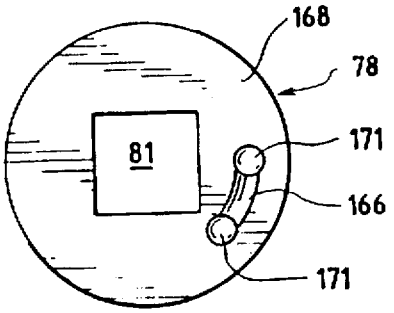
FIG. 10 is a bottom view of one embodiment of the knob of the ratchet wrench in accordance with the present invention.

Preferably, each groove is defined by a pair of opposed side walls 37 and a base wall 39 that extend along the substantial length of the collet 26, as shown best in FIGS. 5, 6 and 8. The width of each groove 200 preferably is substantially the same as the width of each finger 36, and an outwardly extending flare 61A is formed at the leading edge of the grooves 200 to cooperate with flares 33 of the socket. If the socket of FIGS. 15 and 16 is employed, the triangular surface areas 43 desirably are not received within the grooves 200. Additionally, there are six grooves 200 to correspond with the six fingers 36.

The flares 33 formed on adjustable socket 24 and flare 61 or flares 61A function to contract the radius of the open end of the socket 24 as collet 26 is moved forward relative to the socket in a manner hereinafter described. The flares and the flexible fingers 36 also facilitate a springing action when the force applied to the collet is disengaged, causing the collet to spring rearwardly.

It is appreciated that the angles of flare 33 formed on adjustable socket 24 and flare 61 or flares 61A formed on collet 26 may be of any magnitude that accomplishes the objectives of the present invention. In the preferred embodiment, however, the angle defined by the outside of each finger 36 and the outwardly extending leading edge 32 when the socket is in its unflexed state is approximately 40°. The angle defined by the outside wall of collet 26 and the downwardly-extending flare 61 or 61A preferably is approximately 30° (see FIG. 5). If desired, these angles may be increased to enhance the springing action described above, or decreased.

The socket 24 and collet 26 are joined together by stud 28 in any suitable manner. For example, the stud may comprise a groove 70 defined around the stud near its center, and a disk 72 that is mounted to the end of the stud and that is received within the socket 24. The stud 28 extends through apertures 38 and 59 of the socket and collet, respectively. A retainer or clip ring 74 is secured around groove 70, and the ring and disk join together the socket and collet and the ring limits the rearward movement of the collet relative to the socket.

Figure 14:
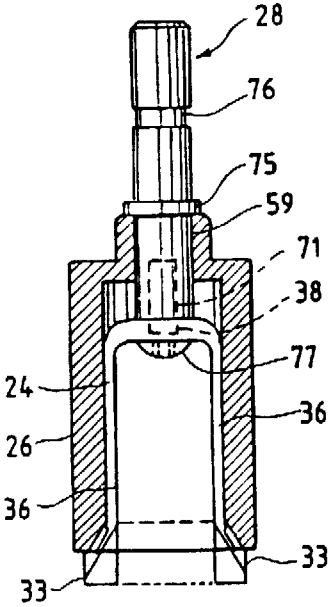
FIG. 14 is a cross section view of the socket assembly in accordance with the invention, illustrating an alternative embodiment of the stud that interconnects the socket and collet.
Figure 18:
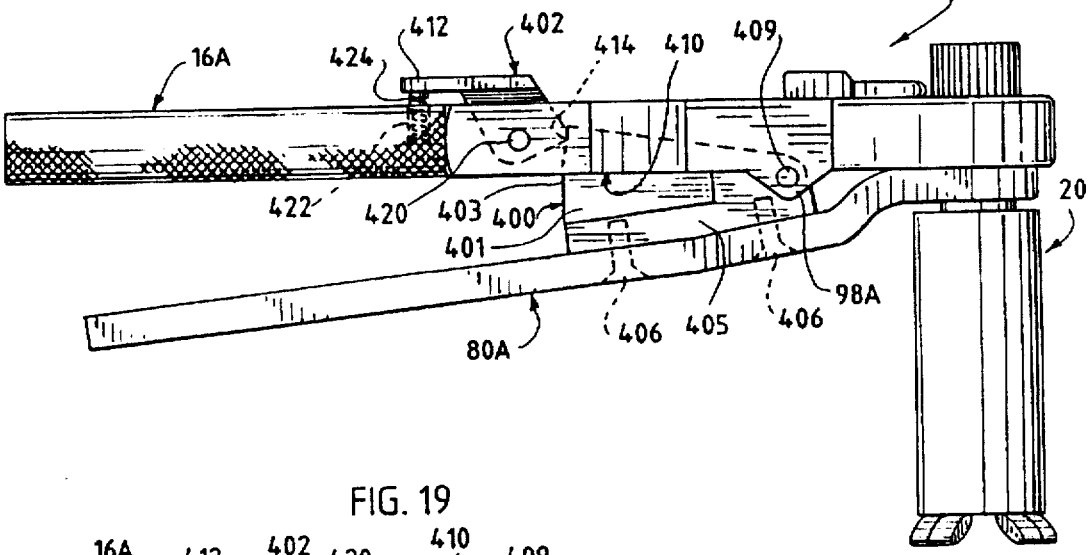
FIG. 18 is an elevation view of the ratchet wrench of FIG. 17.
Figure 19:
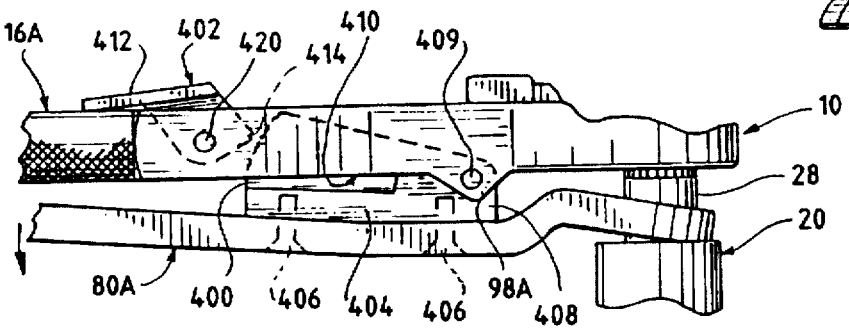
FIG. 19 is a partial broken view of the ratchet wrench of FIGS. 17 and 18, illustrating the lever assembly being unlocked.
Figure 20:
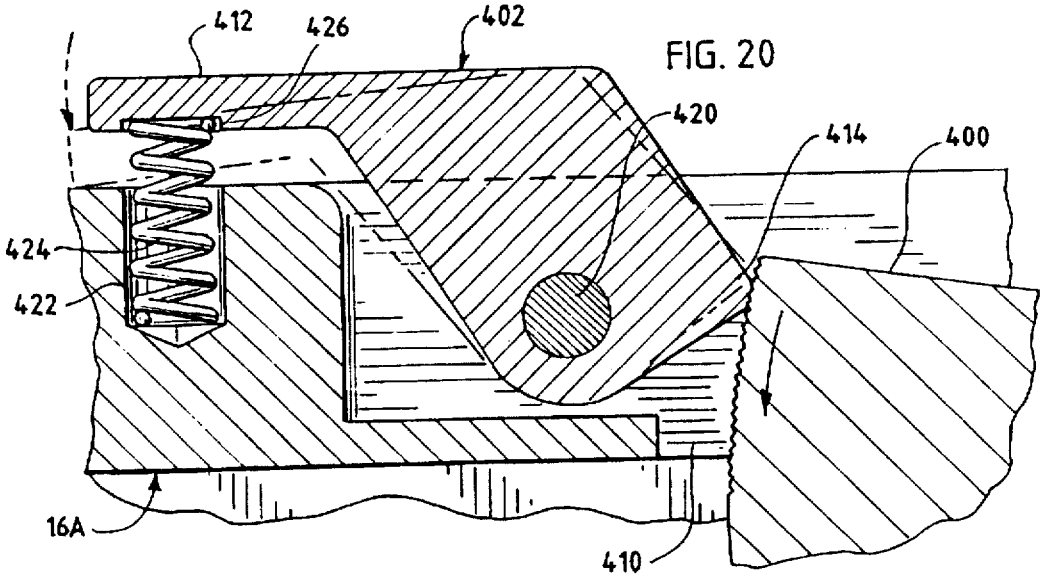
FIG. 20 is an enlarged cross section view taken along lines 20—20 of FIG. 17, illustrating the means for releasably engaging the lever.

Alternatively, a shoulder 75 may extend around the stud 28 for joining together the socket and collect and to limit the rearward movement of the collet (see FIG. 14). The stud desirably includes a bore 71 for receiving a screw or rivet 77 or the like that extends through the aperture 38 of the socket. In this embodiment, aperture 38 may be circular since desirably the rivet 77, and not the stud, extends through aperture 38.

Recess 76 is defined in the stud 28 near its distal end, and a socket assembly locking means is provided for releasably engaging the recess. Recess 76 may be in the form of a single recess extending around the perimeter of stud 28, or four recesses 76 with one recess being defined in each corner of the stud. As shown best in FIGS. 1–2 (and 8), the socket assembly locking means preferably comprises a generally cylindrical hollow knob 78 preferably disposed partially within the circular bore 15 adjacent (e.g. above) the ratchet mechanism 12. The knob 78 is rotatable relative to the ratchet mechanism preferably at least 45°. If desired, a retaining ring 79 may be disposed within channel 85 of circular bore 15.

The base of knob 78 may comprise a square aperture 81 for receiving stud 28, which defines four locking ledges 83. After inserting the stud through the ratchet mechanism 12 and aperture 81 of the knob so that the locking ledges align with the recess 76, the knob can then be rotated approximately 45° causing it to engage the stud.

Knob 78 may be secured adjacent ratchet mechanism 12 in any manner that preferably permits rotation of the knob relative to the ratchet mechanism. In the embodiment of FIG. 8, for example, a bore 160 is defined within the ratchet mechanism for receiving a spring 162 and a substantial portion of a ball 164. A groove 166 that slidingly engages the remaining portion of ball 164 is defined on surface 168 of knob 78, extending preferably about 45° around surface 168. An arcuate detente 171 adapted to releasably engage ball 164 is defined at each end of groove 166.

As shown in FIGS. 1–3, and 8, the base of knob 78 may include a circumferential sill 73 that is disposed between ratchet mechanism 12 and a circular top lip 170 extending around the top of the circular bore 15. The lip 170, a retaining ring 172 secured within the bore, at least one bottom lip 170, a pressure washer 154 and a sleeve 156 may also be used to secure the knob and ratchet mechanism within bore 15. The bottom lip 170 may extend partially or entirely around the bottom of the circular bore.

Locking lever 80 is pivotally mounted to the ratchet wrench 10 and functions as the operating mechanism for controlling the size of the socket 24. Lever 80 may be a straight elongated bar or a bar having one or more bends such as the levers shown in FIGS. 1, 2, 7 and 8. In the embodiment of FIGS. 1 and 2, lever 80 comprises an elongated portion 84, a bend 86, and a free end 88. The lever may have a uniform thickness and a width that gradually increases toward the free end of the lever, which terminates in a bifurcated construction that defines arms 90, 92. Arms 90, 92 straddle the sleeve 57 and aperture 59 to be in operable contact with collet 26, as hereinafter described. If desired, the lever 80 may also have a U-shaped cross-section along its entire length or along a portion of its length, which may reduce the weight of the lever and may be more effective in resisting the stress resulting from the operation of the tool. If desired, a teflon or plastic washer 68 may be positioned on the outside of the sleeve 57 to avoid metal-to-metal contact between the arms and the collet.

The lever 80 may be pivotally attached to the handle 16 in any suitable manner. As shown in FIGS. 1 and 2, for example, the pivotal attachment may be in the form of a rectangular support 96 mounted to the bottom of the bend 86 and a fulcrum 98 mounted to the handle 16. The fulcrum comprises a pair of opposed supports 100 and a conventional bearing pin 102 that extends through a boss 104 defined on the support.

Additionally, a locking mechanism is provided for releasably locking the lever 80 to the wrench 10 at the desired position. In accordance with FIGS. 1 and 2, the mechanism may comprise an arm 110 having a plurality of pin-engaging teeth 112, a tubular member 114, and a spring 116. The arm 110 extends from the lever 80 into a slot 118 defined in the handle 16. The tubular member 114 has a flat end 130 located inside the handle, and a rounded portion that defines a locking mechanism release button 120 positioned on the proximal end of the handle. A longitudinal slot 122 adapted to receive arm 110 is defined within the tubular member 114. A pin 124, adapted to engage one of the pin-engaging teeth 112, is secured to the tubular member within the slot 122, extending perpendicular to the longitudinal axis of the slot. The spring 116 is housed within a bore 126 defined inside the handle 16. One end of the spring remains in contact with the flat end 130 of the tubular member 114 to maintain the engagement of pin 124 and one of the pin engaging teeth 112, and thereby lock the handle 16 to the arm 110. A stem 113 protrudes from tubular member 114 through slot 118 to lock the tubular member slidably within handle 16. If desired, stem 113 may be in the form of a screw engageable with the tubular member. Manual pressure on release button 120 operates to disengage the teeth from the pin and allow the arm to be repositioned at the desired location within the handle.

The described embodiment of the invention can be used as follows. After the socket assembly 20 is fastened to the ratchet wrench 10, the adjustable socket 24 is positioned over the fastener. Lever 80 is then manually squeezed toward the handle 16, causing the collet 26 to slide downwardly over the socket and spring 27 (if included) to compress. As the collet moves downwardly, a camming effect occurs between its internal flare 61 (or flares 61A) and the external flares 33 of the socket, thereby forcing all of the fingers 36 toward one another. This results in the contraction of the open end of the socket. Once the open end of the socket has been contracted so that the finger are in gripping attachment with the fastener, the lever is automatically locked in place by the arm 110 and tubular member 114. The socket wrench is then used in a conventional manner to rotate the fastener.

After the desired rotation of the fastener has been achieved, the user can press release button 120 to unlock the lever 80. As the lever unlocks, fingers 36 exert a springing force on collet 26, which causes the collet to slide rearward relative to the socket and the proximal end of the lever to spring away from the handle. The springing action is also facilitated by a reverse camming effect between the internal flare 61 (or flares 61A) of collet 26 and external flare 33 of socket 24. Due to the rearward movement of the collet relative to the socket, the socket expands and releases the fastener. If spring 27 is included, it will also cause rearward movement of the collet relative to the socket.

Figure 7:
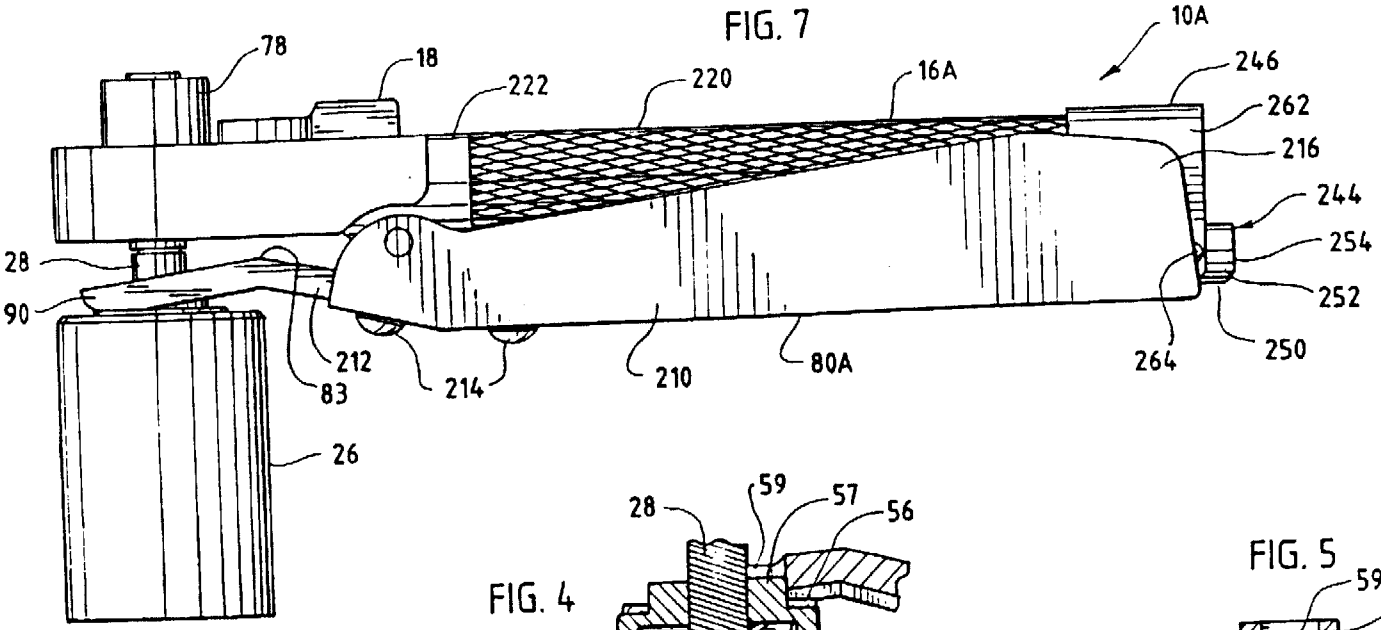
FIG. 7 is an elevation view of a ratchet wrench in accordance with the present invention, illustrating an alternative embodiment of the lever assembly and means for releasably engaging the rear of the lever.

FIGS. 7 and 8 illustrate a ratchet wrench 10A in accordance with the present invention having alternative embodiments of the locking lever assembly, handle and the locking mechanism for releasably locking the lever to the wrench. In the illustrated embodiment, locking lever 80A comprises a gripping portion 210 and a bar pry 212 that are secured together by a pair of fasteners 214. The cross section of gripping portion 210 is generally U-shaped, defining a pair of walls 216 and recess 218 for receiving handle 16A. The U-shaped construction reduces the stress resulting from the operation of the wrench 10A, and also provides a guard between the handle 16A and lever 80A to reduce the likelihood of pinching the user's fingers between the handle and lever. Preferably, there is a slight bend B1 in gripping portion 210 to enhance the travel distance of the distal end of bar pry 212 in response to movement of the proximal end of the lever 80A. The height of walls 216 gradually decreases toward bend B1.

Lever 80A may be pivotally connected to the handle 16A by any suitable means, such as by a bearing pin 102A that extends through walls 216 near the distal end of gripping portion 210 and through a boss 104A defined on handle 16A. Walls 216 preferably are rounded adjacent the bearing pin to facilitate pivoting of lever 80A.

The width of pry bar 212 gradually increases toward its free end, which terminates in a bifurcated construction that defines arms 90, 92. The outside of arms 90, 92 may be rounded, if desired. The pry bar 212 may be bent at points B2, B3 to provide an effective travel distance of its distal end relative to the movement of the proximal end of lever 80A.

The handle 16A comprises first and second members 220, 222. First member 220 is knurled along a portion of its length and is hollow. A cap 224 is secured to the proximal end of the first member.

Figure 11:
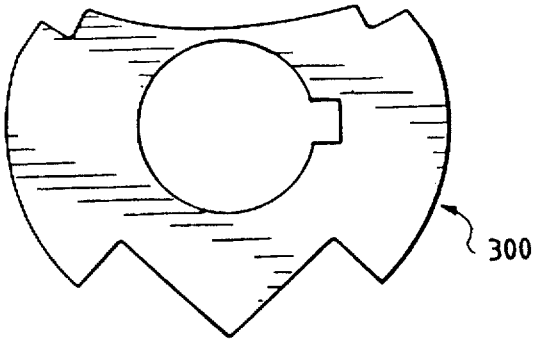
FIG. 11 is a top view of one embodiment of the ratchet reversing mechanism of the ratchet wrench in accordance with the present invention.

The second member 222 comprises a cylindrical proximal end 226 that is received within the hollow first member 220 and secured to the first member by a fastener 227. The ratchet reversing mechanism 300 (FIG. 11) and its corresponding spring 302 and ball 304 (FIG. 8) are housed within the second member 212 in a conventional manner.

The locking mechanism of FIGS. 7–8 for releasably locking the lever 80A to wrench 10A comprises an arm 240 having a plurality of teeth 242, a release mechanism 244, a bracket 246 and a spring 248. As best shown in FIGS. 8 and 9, release mechanism 244 comprises a top 250, a pair of side walls 252, a button end 254 and a distal end 256. An aperture 258 is defined in top 250 for releasably engaging teeth 242, and a pair of slots 260 is defined in side walls 252.

Figure 13:
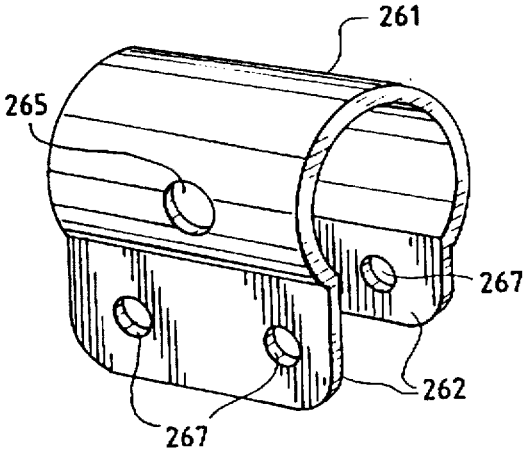
FIG. 13 is a perspective of the bracket that can be used with the ratchet wrench of FIGS. 8 and 9.
Figure 17:
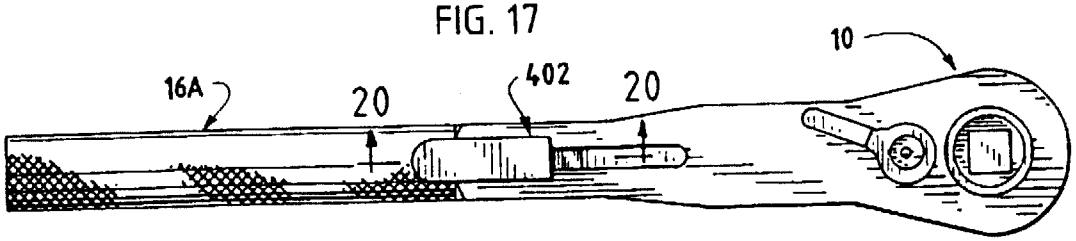
FIG. 17 is a top plan view of a ratchet wrench in accordance with a further embodiment of the invention, illustrating an alternative embodiment of the lever assembly and means for releasably engaging the lever.

Bracket 246 compresses a pair of side walls 262 and an arcuate portion 261 that extends around the distal end of handle 16A and is secured to the handle by a fastener 263 extending through bores 265 (FIG. 13). Each side wall 262 of bracket 246 is interconnected by a pair of pins 264, 266 that extend through apertures 267 of the bracket and also through slots 260 of release mechanism 244 to permit sliding movement of the release mechanism. A spring 248 connects the distal end 256 of the release mechanism to pin 266 in any suitable manner.

The locking mechanism illustrated in FIGS. 7 and 8 operates as follows. As lever 80A is manually squeezed toward handle 16A, arm 240 causes release mechanism 244 to slide in the distal direction and the bar pry 212 causes collet 26 to slide downwardly over the socket 24. Once the open end of socket 24 is contracted so that the fingers are in gripping attachment with the fastener, the lever 80A is automatically locked in place by spring 248 which effects engagement of teeth 242 with the release mechanism 244 at aperture 258. After the desired rotation of the fastener has been achieved, the user presses button end 254 to release lever 80A.

FIGS. 17–22 reveal an alternative embodiment of the mechanism for releasably locking the lever 80A to wrench 1OA in the form of a ratchet member 400 mounted to the lever and a pawl member 402 secured to the wrench 10 or handle 16A. The ratchet member 400 preferably is rigidly mounted to the bottom side of the lever 80A in any suitable manner, such as by screws 406 or the like, and is pivotally connected to the wrench 10 by a pivot pin 409 or the like to the fulcrum 98A of handle 16A.

Figure 21:
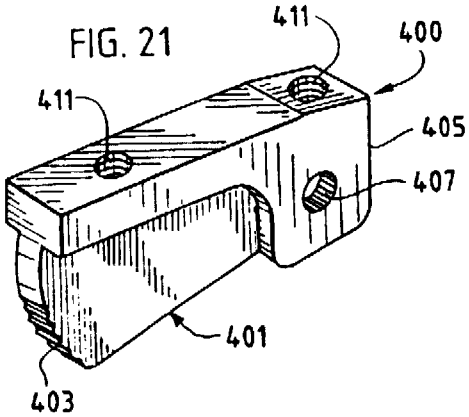
FIG. 21 is a perspective view of the rack employed with the means for releasably engaging the lever FIGS. 17–20.

In the illustrated embodiment, for example, the ratchet member 400 is in the form of a rack that defines a ratchet portion 401 member having a plurality of teeth 403, and an integral and generally L-shaped support member 405 (see FIG. 21). A bore 407 is defined on one portion of the support member for receiving pivot pin 409. The other portion of the support member 405, which may be slightly bent to compliment the configuration of the lever 80A, defines a pair of bores 411 for receiving screws 406. In addition, an opening 410 is defined in the wrench 10 for receiving at least a portion of the ratchet member 400 to facilitate pivoting action.

The pawl member 402 comprises a cantilever 412 and a pawl mechanism 414 having an ear 416 or the like that extends partially into the opening 410 and is pivotally mounted within the opening by a pivot pin 420. A circular bore 422 is defined in the handle adjacent the cantilever 412 for receiving a spring 424 that is operably attached to the cantilever and the handle. If desired, a rectangular groove 426 may be defined on one side of the cantilever 412 for receiving one end of the spring 424.

Figure 22A:
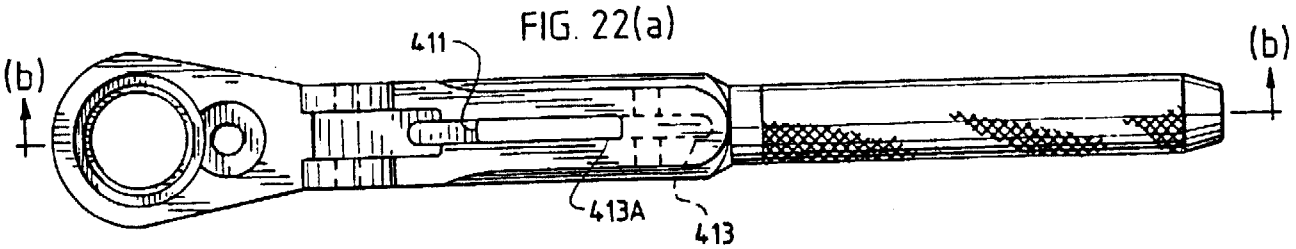
FIG. 22(*a*) is a top view of the wrench of FIGS. 17–20, with the lever assembly and means for releasably engaging the lever removed to illustrate the opening for receiving the engaging means.
Figure 22B:
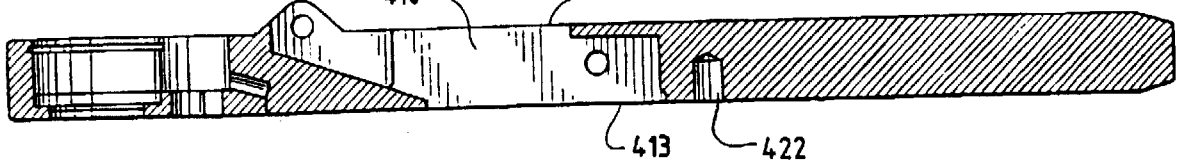

As shown best in FIGS. 22(*a*)–(*b*), opening 410 preferably is defined by a pair of slots 413, 413A defined on approximately 180 degrees apart on the wrench 10 (e.g. the top and bottom of the wrench). Slot 413, which receives the pawl member, and slot 413A, which receives the ratchet member, are offset from each other relative to the longitudinal axis of the wrench 10, as illustrated, but are connected within the wrench to form the continuous opening 410.

The locking mechanism illustrated in FIGS. 17–22 operates as follows. As lever 80A is manually squeezed toward handle 16A the desired amount (i.e. so that the fingers 36 are in gripping attachment with the fastener), the ratchet member 400 engages the pawl member 402. After the desired rotation of the fastener has been achieved, the user presses the cantilever 412, which disengages the ratchet and pawl members, releases lever 80A, and releases the fingers 36 from the fastener.

FIGS. 23–26 show a wrench 10 in accordance with an alternative embodiment of the invention having a means for pneumatically activating the socket assembly, which, in the preferred embodiment, comprises a wedge 428 for causing movement of the collet 26 relative to the socket 24, a piston 430 having a shaft or rod 432 connecting the piston to the wedge, an air cylinder 433 housing the piston, an air passage line 434 for connecting the air cylinder to an air supply inlet 436, and a socket control valve 438 disposed along the air passage line. The piston 430 is in operable engagement with a piston return spring 440 housed within the air cylinder 433, and, if desired, O-rings 442 may be disposed about the piston 430 within the air cylinder.

Figure 23:
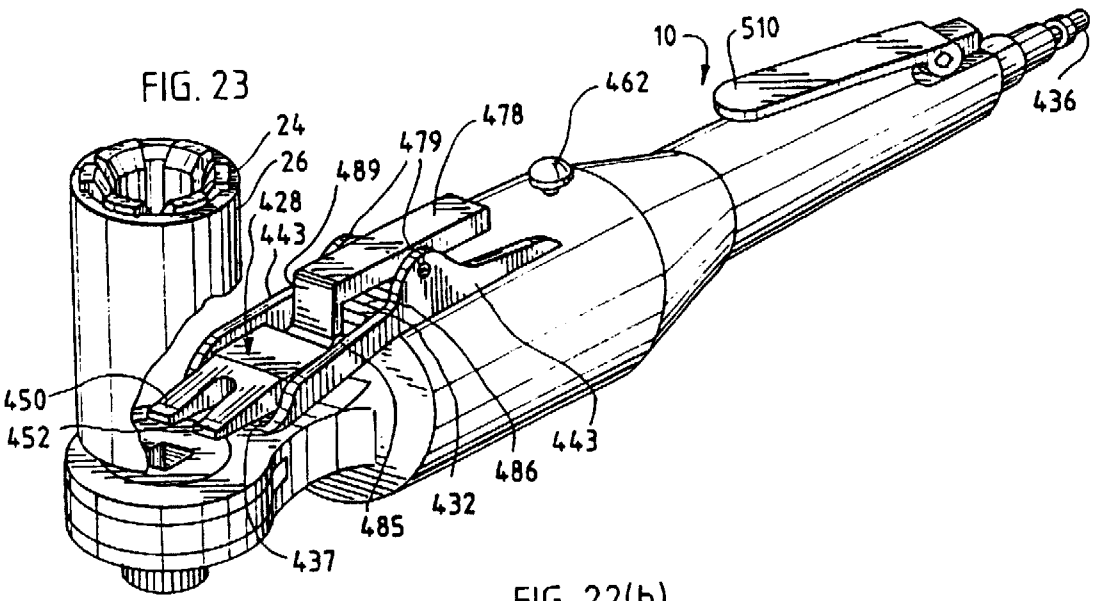
FIG. 23 is a perspective view of a pneumatically activatable ratchet wrench in accordance with a further embodiment of the invention, illustrating in broken view a mechanism for controlling the size of the socket.
Figure 25:
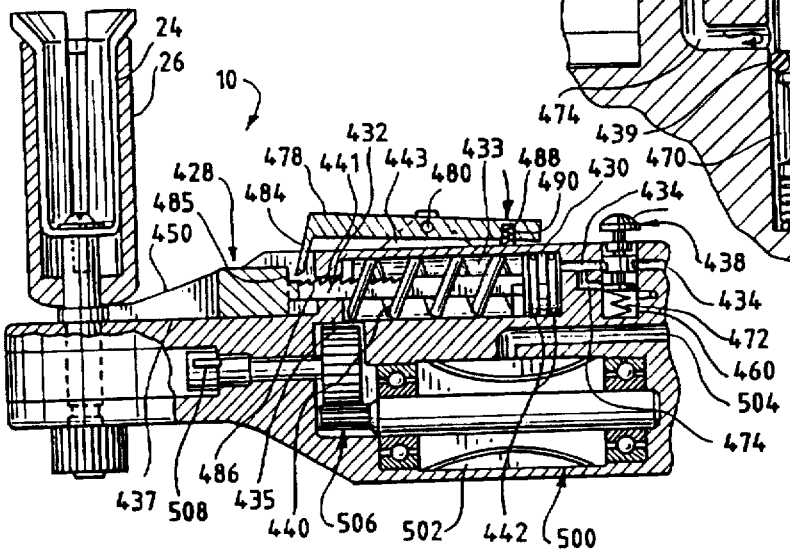
FIG. 25 is a partial cross section view similar to FIG. 24, except that it illustrates the socket control mechanism or wedge in the disengaged position.
Figure 24:
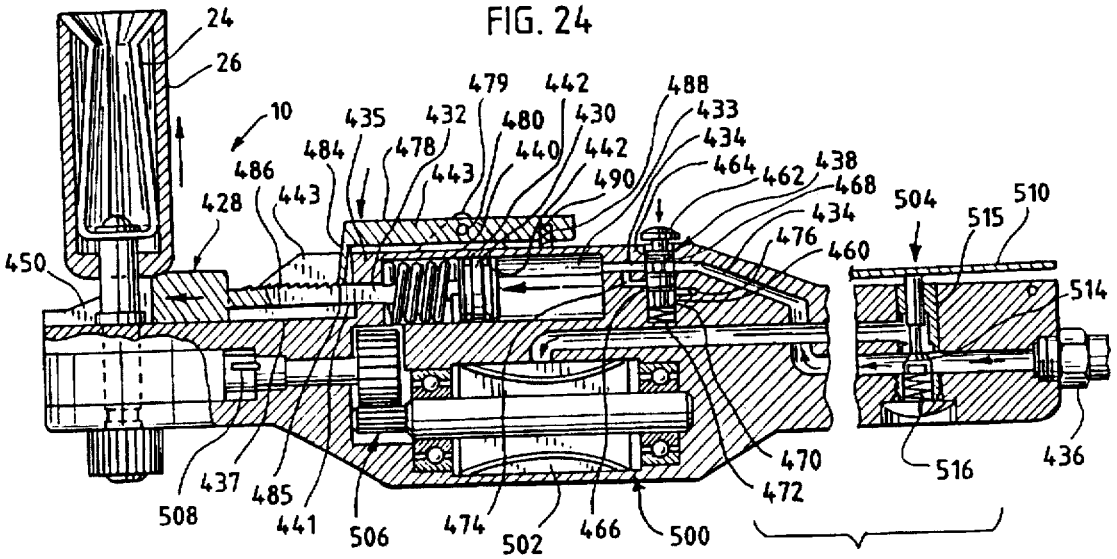
FIG. 24 is a partial cross section, broken view taken along the longitudinal axis of the ratchet wrench of FIG. 23, illustrating the socket control mechanism or wedge in operable contact with the collet.

The air cylinder 433 is defined on its distal end by a housing wall 435 that extends generally perpendicular to the longitudinal axis of the wrench 10. A flat surface 437 is defined on the wrench on the opposite side of the housing wall to provide a sliding surface for the wedge 428. A hole 441 is defined in the housing wall 435, and the piston rod 432 extends through the hole into a channel, which is defined by a pair of opposed walls 443 that are mounted to the wrench 10. As shown in FIGS. 23–25, the walls 443 extend above the cylinder and terminate distal of the housing wall 435.

The wedge 428 terminates in a bifurcated construction, defining a pair of arms 450, 452. The thickness of the arms gradually decreases from their proximal to their distal ends to define camming surfaces.

Figure 26:
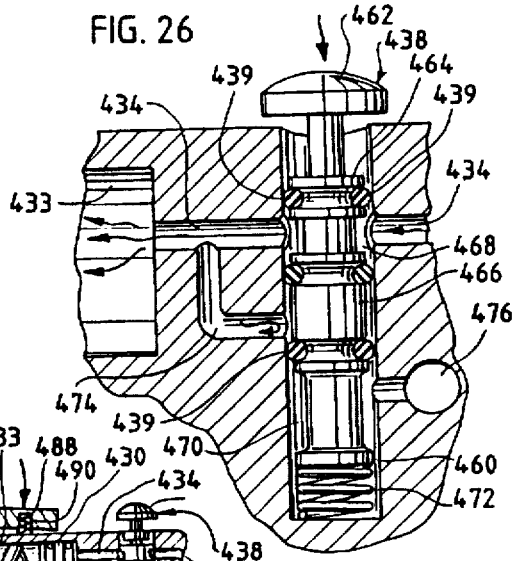
FIG. 26 is a partial cross section view of the ratchet wrench of FIGS. 23–25, illustrating the socket control valve for activating the socket control mechanism in a depressed position.

Air supply to the air cylinder 433 is controlled by socket control valve 438, which, preferably, is a two-position, normally-closed, three-way valve. The socket control valve 438 is received within a bore 460 defined in the handle 16A and includes a manually-operable pushbutton 462 that extends from the bore. O-rings 439 may be disposed about the valve within the bore 460, as shown in FIG. 26.

In the illustrated embodiment, the socket control valve 438 comprises a pair of unrelieved or sealed portions 464, 466 and a pair of relieved or unsealed portions 468, 470 of reduced diameter. When the socket control valve 438 is in its normally-closed position, the sealed portion 466 is disposed within the air passage line 434 to prevent the passage of air. When the pushbutton 462 is manually depressed, however, the unsealed portion 468 becomes aligned with the air passage line 434 to permit flow of air into the air cylinder 433 and permit the wedge to cause movement of the collet 26 relative to the socket 24 (see FIGS. 24 and 26). A return spring 472 may be housed in the bore 460 underneath the socket control valve for automatically returning the valve to its closed position when the pressure on the pushbutton 462 is removed.

In the preferred embodiment, an auxiliary air passage line 474 is also provided for releasing the air pressure when the socket control valve 438 returns to its closed or undepressed state (i.e., closes the air passage line 434). The auxiliary passage 474 line extends from the air passage line 434 and terminates in an aperture 476 defined on the wrench, as shown in FIG. 26. The socket control valve 438 is also aligned with the auxiliary passage line 474, closing it when the air passage line 434 is open. When the socket control valve 438 is returned to its undepressed state (i.e. closes the air passage line 434), the unsealed portion 470 becomes aligned with the auxiliary passage line, allowing air to pass outside the wrench (see FIG. 25).

A lever 478 may also be included that automatically locks the piston rod 432 and wedge 428 to the desired position when air pressure is supplied to the air cylinder 433, which prevents "floating" of the wedge 428. In the illustrated embodiment, for example, the lever 478 is pivotally mounted to the wrench 10 by a pivot pin 480 mounted to the enlarged portions 479 of walls 443. The lever 478 terminates in a arm 484 that extends generally towards the axis of the handle and terminates in a bevel 485. Serrations 486 are defined on the piston rod 432, and the beveled arm 484 is engageable with the serrations at alternate locations within a channel defined by walls 443. A lever return spring 488, received partially within a bore 490 defined on the bottom of lever 478, is in operable engagement with the lever 478 near its end opposite the beveled arm 484 for releasing the lever from the rod 432 when pressure is applied to the end of the lever adjacent the spring, which is normally done after the fastener has been secured.

Any suitable means may be employed to rotate the fastener once it is secured by the pneumatically-activated socket such as, for instance, the illustrated means which is an example of a pneumatic system known in the art (see FIGS. 24 and 25). In this embodiment, an air motor 500 is provided having four rotor blades 502 in communication with an air passage line 504 that is connected to the air supply inlet 436. A gearing system 506 converts the high speed rotation of the rotor blades to a lower speed rotation of an offcenter cam 508, which in turn causes the socket to tighten the fastener in accordance with convention.

A manually-operable ratcheting lever 510 may be pivotally secured to the proximal end of the handle 16A, and used for pneumatically securing the fastener. In accordance with the invention, the lever 510 is operably attached to a control valve 514 that is substantially received within a bore 515 so that when the lever 510 is depressed it permits the passage of air along both air passages 434, 504. In the preferred embodiment, the control valve 514 is a two position, normally closed, three way valve. A return spring 516 may be housed in bore 515 underneath the valve 514 for automatically returning the valve 514 to its closed position when the pressure on lever 510 is removed.

It is appreciated that, in accordance with convention, wrench 10 may be separately engageable with a plurality of socket assemblies of different sizes to accommodate fasteners of different radii. The socket assemblies of the present invention, however, are contractible and expandable so that a single socket assembly can be used for a range of fastener sizes. For example, a socket having an unflexed radius of ½" may be usable on fasteners having a radius in the range of ¼"0 to ½". Similarly, a socket having a radius of ¾", 1" or 1¼" may be usable on fasteners having a radius in the range of ½" to ¾", ¾" to 1", and 1" to 1¼", respectively. Obviously, the sockets can be sized differently to encompass different ranges or to accommodate fasteners having radius less than ½ or greater than 1¼".

The foregoing description is for purposes of illustration only and is not intended to limit the scope of protection accorded this invention. The scope of protection is to be measured by the following claims, which should be interpreted as broadly as the inventive contribution permits.

What is claimed is:

1. A device for applying a torque to a fastener, the device comprising:

(a) a socket assembly having:
  (i) a contractible and expandable socket;
  (ii) a collet disposed substantially about the socket for effecting engagement of the socket with the fastener, the collet defining an aperture; and
  (iii) a stud interconnecting the socket and the collet, the stud being received by the aperture, the stud having a recess; and (b) a rotatable knob defining a bore for receiving the stud, the knob being rotatable to alternately engage and disengage the stud.

2. A device for applying a torque to a fastener comprising:

(a) a ratchet;

(b) a socket assembly, the socket assembly comprising:
  (i) a contractible and expandable socket;
  (ii) a collet disposed substantially about the socket for effecting engagement of the socket with a fastener;
  (iii) a spring in operable contact with the collet and socket to apply a separation force between the collet and socket; and
  (iv) means for interconnecting the socket and the collet, the interconnecting means comprising a stud and an aperture formed in the collet adapted to receive the stud; and (b) means for releasably locking the socket assembly to the ratchet comprising a knob that is rotatable relative to the ratchet to alternately engage and disengage the stud.

3. The device of claim 2 wherein the aperture is square and wherein most of the length of the stud has a square cross section.

4. The device of claim 3 wherein a recess is formed in the stud and wherein the knob is releasably engageable with the recess to lock the stud to the ratchet.

5. The device of claim 4 wherein the knob comprises four locking ledges that define a bore, the ledges being releasably engageable with the stud.

6. The device of claim 2 wherein the socket and collet each have first and second ends, the first ends being open, the second ends being secured together in a manner to permit sliding of the collet relative to the socket, and the second ends being separated by the spring.

7. The device of claim 6 wherein the spring is disposed within the collet outside the socket.

8. A device for applying a torque to a fastener, the device comprising:

(a) a socket assembly having:
  (i) a contractible and expandable socket;
  (ii) a collet disposed substantially about the socket for effecting engagement of the socket with the fastener; and
  (iii) a stud interconnecting the socket and the collet; and (b) a rotatable knob defining a first aperture for receiving the stud, the knob being rotatable to alternately engage and disengage the stud.

9. The device of claim 8 further comprising a cam means for applying a separation force between the socket and the collet.

10. The device of claim 8 wherein the stud defines a recess and a portion of the knob is adapted to extend within the recess to engage the stud.

11. The device of claim 10 wherein the knob has a base, said portion and first aperture being defined by the base.

12. The device of claim 11 wherein the knob comprises four locking ledges that define said portion and first aperture, the locking ledges adapted to engage the stud.

13. The device of claim 10 wherein the collet defines a second aperture, and wherein the first and second apertures are generally square and wherein most of the length of the stud has a square cross section.

14. The device of claim 10 further comprising a ratchet, the socket assembly being in operable engagement with the ratchet.

15. The device of claim 10 wherein the knob is substantially hollow.

16. The device of claim 10 wherein the recess extends substantially around the longitudinal axis of the stud.

17. The device of claim 10 wherein a first portion of the stud extends outside the socket and the collet and a second portion of the stud extends inside the socket and collet, the recess being formed on the first portion.

18. The device of claim 17 further comprising means for engaging the socket and collet together in a manner to permit the collet to slide relative to the socket to effect engagement of the socket with the fastener.

19. The device of claim 18 wherein the engaging means comprises a grooved formed in the first portion of the stud and a retainer received within the groove for limiting the rearward movement of the collet relative to the socket.

20. The device of claim 19 wherein the socket defines a third aperture for receiving the stud and wherein the engaging means further comprises a disk mounted to the second portion of the stud to limit the forward movement of the socket relative to the collet.

21. The device of claim 18 wherein the engaging means comprises a shoulder on the first portion of the stud for limiting the rearward movement of the collet relative to the socket.

22. The device of claim 21 wherein the socket defines a third aperture for receiving the stud and wherein the second portion of the stud defines a passage, the passage adapted to receive a rivet for limiting the forward movement of the socket relative to the collect.

23. The device of claim 8 wherein the knob has a base, an arcuate groove defined on the outside surface of the base, and an arcuate detente formed at each end of the groove, and wherein the device defines a passage adjacent the aperture, a spring that is received within the passage, and a ball being in operable engagement with the spring within the passage to exert an outward force on the ball, the ball being in sliding engagement with the groove during rotation of the knob and adapted to releasably engage the detentes to releasably lock the knob to prevent rotation of the knob.

24. The device of claim 23 further comprising a ratchet mechanism received within the first aperture, the passage being defined by the ratchet mechanism.

25. The device of claim 8 further comprising a cam means for applying a separation force between the socket and the collet.

26. The device of claim 8 wherein the socket has a radially adjustable gripping means for fitting fasteners of different size and further comprising a cam means for contracting the radius of the gripping means, the cam means comprising:

(i) a first flared portion formed at one end of the collet; and (ii) a second flared portion formed by the leading edge of the socket which extends outward from the body of the socket and then laterally inward and backward, the second flared portion cooperating with the first flared portion.

27. The device of claim 26 wherein the gripping means comprise a plurality of longitudinally-extendible, parallel fingers, the fingers adapted to change the diameter of the gripping means.

28. The device of claim 8 further comprising a handle and a pivotable lever being operable to move the collet into operable engagement with the socket, thereby to cause the socket to attach to the fastener, wherein the improvement comprises:

means for releasably locking one end of the lever to the handle at alternate positions, the locking means comprising an arm extending from the second end of the lever for engagement with the handle and a release button at the rear end of the handle to disengage the arm and unlock the lever from the handle;

the locking means further comprises a spring disposed within the handle and a tubular member disposed substantially within the handle, one end of the tubular member extending outside the handle to form the release button, the spring being in operable engagement with the other end of the tubular member.

29. The handle of claim 28 wherein the locking means further comprises a plurality of teeth formed on the arm, a first slot formed in the tubular member, and a pin mounted in the first slot and engageable with the teeth at alternate locations.

30. The handle of claim 29 wherein the locking means further comprises a second slot formed in the handle for receiving the arm, and a stem attached to the tubular member within the handle, the stem extending through the second slot to lock the tubular member slidably within the handle.

31. The device of claim 8 further comprising pneumatically activatable drive means operable to slide the collet relative to the socket to cause the socket to attach to the fastener.

32. The device of claim 31 wherein the pneumatically activatable drive means comprises cam means operable to slide the collet relative to the socket in response to pneumatic pressure.

33. The device of claim 32 further comprising a handle attachable and usable with the socket and collet and wherein the cam means comprises a wedge adapted to slide between the collet and the handle.

34. The device of claim 33 further comprising a lever for releasably locking the wedge in place in response to pneumatic pressure and for unlocking the wedge after the fastener has been secured, the lever being pivotally connected to the handle.

35. The device of claim 34 wherein the pneumatically activatable drive means further comprises a piston operable to cause the wedge to slide between the collet and the handle in response to pneumatic pressure.

36. The device of claim 35 wherein the pneumatically activatable drive means further comprises a piston shaft in operable engagement with the piston and being releasably engageable with the lever at alternate positions along the length of the piston shaft.

37. The device of claim 33 wherein the the stud secures the socket and collet to the handle, the wedge having a bifurcated construction to define a slot for receiving the stud.

38. The device of claim 36 wherein the pneumatically activatable drive means further comprises a housing for the piston, a passage for supplying pneumatic pressure to the housing and a valve aligned with the passage for permitting pneumatic pressure to enter the housing.

39. The device of claim 38 wherein the valve is received within a bore defined in the wrench and includes a push-button extending outside the bore, the push-button being operable to open the valve in response to pressure applied to the push button.

40. The device of claim 39 further comprising an auxiliary passage connected to the passage for releasing the pneumatic pressure from the housing, the valve also being aligned with the auxiliary passage and being open along the auxiliary passage when it is closed along the passage.

41. The device of claim 40 wherein the valve is a two-position, three-way valve that is normally closed along the passage.

42. The device of claim 38 further comprising a valve spring received within the bore for returning the valve to the closed position.

43. The device of claim 31 further comprising a pneumatically activatable means for applying torque to the fastener.

44. The device of claim 43 wherein the pneumatically activatable drive means comprises a first passage for supplying pneumatic pressure and the pneumatically activatable means for applying a torque comprises a second passage for supplying pneumatic pressure, the first and second passages being in fluid flow communication when supplying pneumatic pressure.

45. The device of claim 44 further comprising a valve connecting the first and second passages for permitting the flow of pneumatic pressure within the first and second passages.

46. The device of claim 45 wherein the valve is a two position, normally-closed, three-way valve.

47. The device of claim 45 further comprising a handle attachable and usable with the socket and collet and a lever pivotally mounted to the handle and in operable engagement with the valve, the lever being operable to alternately open and close the valve to permit the flow of pneumatic pressure within the first and second passages.

48. The device of claim 33 wherein the collet has a closed end, the outside of the closed end being rounded to further define the cam means.

49. The device of claim 8 further comprising a handle attachable and usable with the socket; and a lever pivotally attached to the handle, the lever being operable to move the collet into operable engagement with the socket to cause the socket to attach to the fastener; and means for releasably locking the lever to the handle at alternate positions, the locking means comprising a ratchet member mounted to the lever and a pawl member pivotally secured to the handle, the ratchet and pawl members being engageable.

50. The device of claim 49 wherein the pawl member comprises a cantilever member and an ear that extends partially into an opening defined in the handle and is pivotally mounted within the opening.

51. The device of claim 50 further comprising a spring in operable engagement with the handle and the cantilever, whereby application of manual pressure to the cantilever causes disengagement of the ratchet and pawl members.

52. The device of claim 51 wherein a bore is defined in the cantilever for receiving a portion of the spring.

53. The device of claim 50 wherein the ratchet member is rigidly mounted to the under side of the lever and pivotally mounted to the handle.

54. The device of claim 51 wherein a portion of the ratchet member extends into the opening.

55. The device of claim 54 wherein the opening is defined by a pair of connecting slots defined on the handle approximately 180 degrees apart, the slots being offset from each other relative to the longitudinal axis of the handle.

* * * * *